United States Patent [19]

Kuroyanagi et al.

[11] Patent Number: 4,469,069

[45] Date of Patent: Sep. 4, 1984

[54] FUEL INJECTION DEVICE

[75] Inventors: Masatoshi Kuroyanagi, Kariya; Masahiko Suzuki, Aichi; Shizuo Kawai, Kariya, all of Japan

[73] Assignees: Nippondenso Co., Ltd., Kariya; Toyota Jidosha Kabushiki Kaisha, Toyota, both of Japan

[21] Appl. No.: 510,304

[22] Filed: Jul. 1, 1983

[30] Foreign Application Priority Data

Jul. 13, 1982 [JP] Japan ..... 57/121742

[51] Int. Cl.[3] ..... F02M 39/00; F02D 1/06

[52] U.S. Cl. ..... 123/447; 123/506; 417/289

[58] Field of Search ..... 123/506, 496, 447, 446, 123/504; 417/289, 283, 462

[56] References Cited

U.S. PATENT DOCUMENTS

| | | | |
|---|---|---|---|
| 2,810,375 | 10/1957 | Froehlich | 123/447 |
| 3,908,621 | 9/1975 | Hussey | 123/447 |
| 4,029,071 | 6/1977 | Saito | 123/496 |
| 4,164,921 | 8/1979 | Hofer | 123/506 |
| 4,211,203 | 7/1980 | Kobayashi | 123/506 |
| 4,271,805 | 6/1981 | Kobayashi | 123/506 |
| 4,407,253 | 10/1983 | Bauer | 123/506 |

*Primary Examiner*—Charles J. Myhre
*Assistant Examiner*—Carl Stuart Miller
*Attorney, Agent, or Firm*—Cushman, Darby & Cushman

[57] ABSTRACT

A fuel injection device injects pressurized fuel in a combustion chamber of an internal combustion engine. The device is provided with an accumulator. The accumulator accumulates part of the pressurized fuel to be injected in the combustion chamber in accordance with a given operating state of the engine, thereby obtaining an optimum injection rate throughout the entire operating range of the engine.

13 Claims, 5 Drawing Figures

FUEL INJECTION DEVICE

BACKGROUND OF THE INVENTION

The present invention relates to a fuel injection device for an internal combustion engine and, more particularly, to a fuel injection device wherein a fuel injection rate can be adjusted in accordance with operating states of the engine.

In general, the performance of an internal combustion engine greatly depends on the method of fuel injection into a combustion chamber. In particular, in a direct fuel injection type of diesel engine, a rate of fuel injection into the combustion chamber directly influences the combustibility of the fuel, and so, greatly influences engine performance.

For example, a diesel engine has a higher combustion noise than that of a gasoline engine when it is idling. In order to reduce idling noise, it is known to decrease an injection rate without decreasing the injection amount of fuel. Furthermore, it is very effective to operate the engine at an intermediate or high speed under conditions such that the injection rate is kept low before the fuel is ignited in the combustion chamber and the rate is abruptly increased at the time of ignition, thereby obtaining high output power.

As may be apparent from the above description, the fuel injection rate must be adjusted in accordance with a given operating state of the engine such that combustion noise is decreased during idling and such that the output power of the engine is increased.

SUMMARY OF THE INVENTION

The present invention has been made in consideration of the above situation, and has for its object to provide a fuel injection device wherein part of the fuel to be injected into a combustion chamber is accumulated in accordance with an operating state of the engine so as to inject the fuel at an optimum injection rate throughout the entire operating range of the engine.

In order to achieve the above and other objects of the present invention, there is provided a fuel injection device for injecting pressurized fuel into a combustion chamber of an internal combustion engine, comprising:

a pump housing;

a pump cylinder provided in said pump housing;

a pump plunger fitted in said pump cylinder to be reciprocal therein, said pump plunger defining a fuel pressurizing chamber for receiving the fuel in said pump cylinder;

pressurizing means for reciprocating said pump plunger in said pump cylinder in synchronism with operation of the engine, thereby pressurizing the fuel in the fuel pressurizing chamber to supply the pressurized fuel to the combustion chamber; and an accumulator for accumulating part of the pressurized fuel delivered from the fuel pressurizing chamber to the combustion chamber, said accumulator including cylinder means having a first cylinder portion and a second cylinder portion, piston means having an accumulator piston, said accumulator piston having first and second piston portions for reciprocating in said first and second cylinder portions, respectively, said first piston portion defining an accumulation chamber in said first cylinder portion which receives the part of the pressurized fuel pressurized by the fuel pressurizing chamber, said second piston portion being pivotal in said second cylinder portion and defining a fluid-tight chamber filled with a fluid therein, said second cylinder portion having a spill port, the spill port being capable of communicating with the fluid-tight chamber and closed by a predetermined position of said second piston portion upon pivotal movement of said second piston portion, whereby the fluid in the fluid-tight chamber is spilled through the spill port when the spill port is opened, so that said accumulator piston is moved by a pressure of the part of the pressurized fuel in said accumulation chamber so as to increase a volume of the accumulation chamber, and the fluid-tight chamber is closed when the spill port is closed, so that movement of said accumulator piston is interrupted, supplying means for supplying a pressurized fluid whose pressure is adjusted in accordance with a given operating state of the engine, and adjusting means having a fluid pressure chamber which receives the pressurized fluid so as to adjust a pivotal position of said second piston portion in accordance with a variation in pressure of the pressurized fluid in the fluid pressure chamber, thereby adjusting an axial displacing distance of said accumulator piston until said second piston portion closes the spill port.

DETAILED DESCRIPTION OF THE PREFERRED EMBODIMENT

Figure 1:
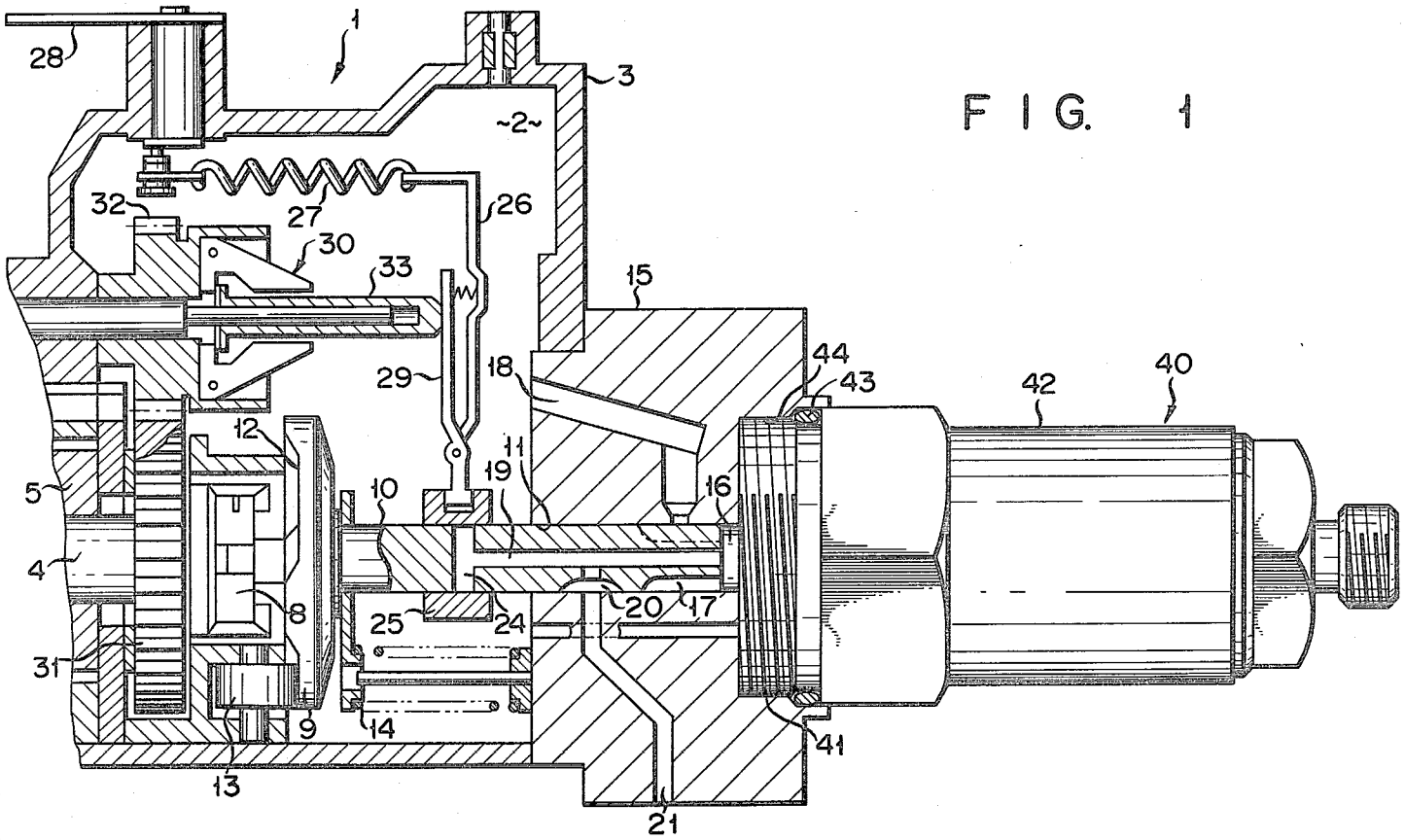
FIG. 1 is a sectional view of a fuel injection device according to an embodiment of the present invention.
Figure 2:
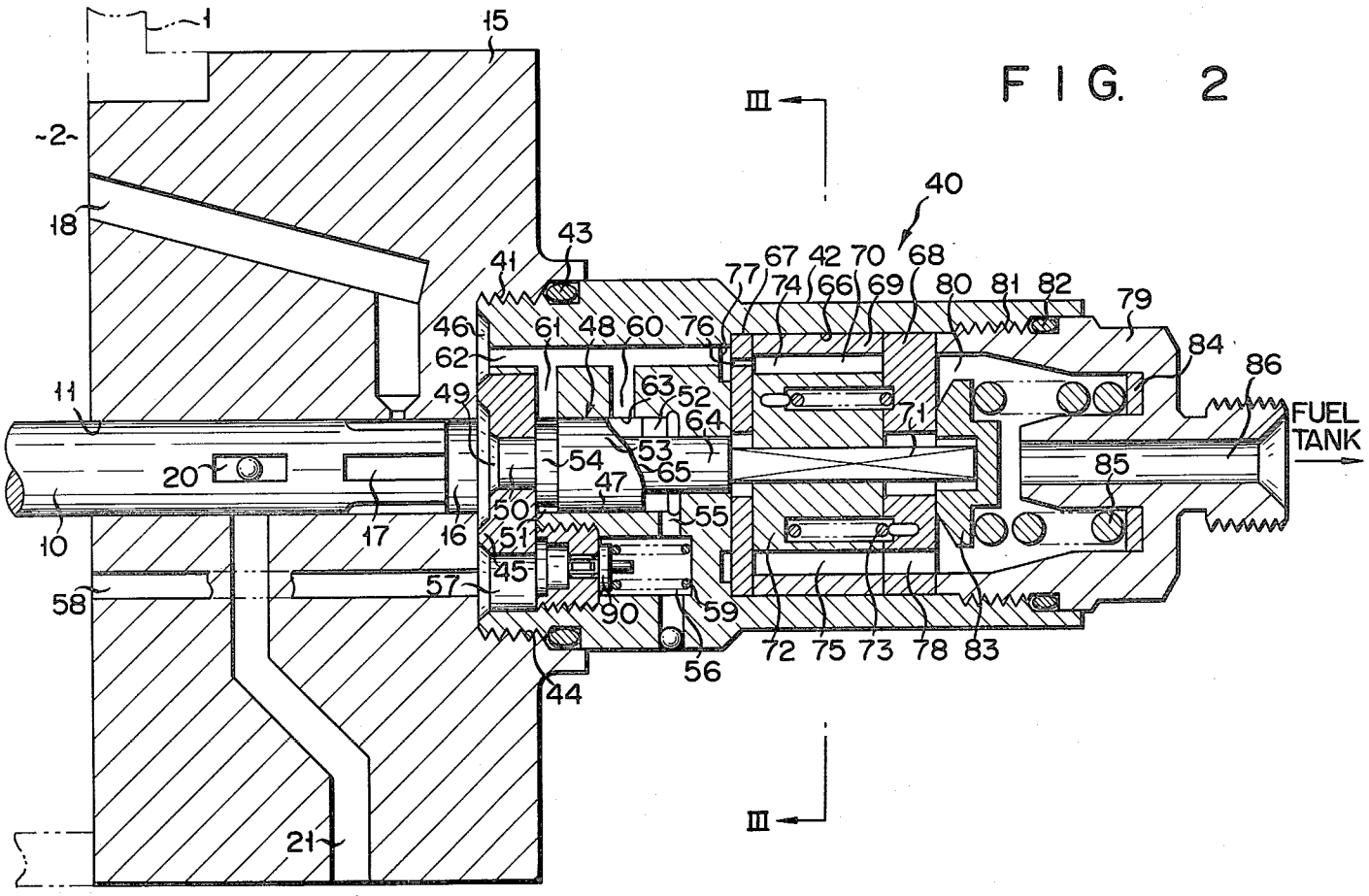
FIG. 2 is a sectional view of an accumulator used in the fuel injection device shown in FIG. 1.
Figure 3:
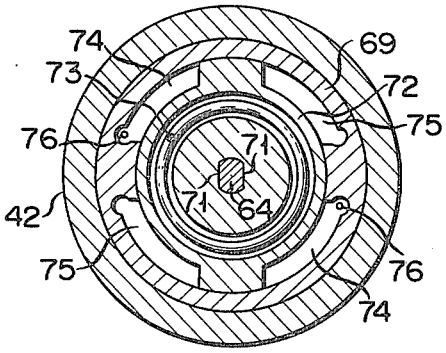
FIG. 3 is a sectional view of the accumulator in FIG. 2 taken along the line III—III therein.

FIGS. 1, 2 and 3 show the construction of a fuel injection device for an internal combustion engine according to a first embodiment of the present invention.

FIG. 1 shows a distributor type fuel injection pump 1 used in the device. Since the pump 1 is well known, it will be only briefly described as follows.

The pump 1 has a pump housing 3 which defines a fuel supply chamber 2 therein. A cam shaft 4 is rotatably supported in the pump housing 3. One end of the cam shaft 4 extends outside the pump housing 3 and is connected to a crank shaft (not shown) of a diesel engine through a power transmission mechanism (not shown). That is, the cam shaft 4 is rotated in synchronism with the diesel engine. A fuel pump 5 is connected to a portion of the cam shaft 4. Upon rotation of the cam shaft 4, the fuel pump 5 is driven to supply fuel from a fuel tank (not shown) to the fuel supply chamber 2.

It should be noted that the pressure of the fuel supply chamber 2 increases in accordance with the operational speed of the engine. A face cam 9 is coupled to the other end of the cam shaft 4 which extends inside the pump housing 3 through a joint 8. The face cam 9 is also connected to a plunger 10 which is coaxial with the cam shaft 4. The plunger 10 is slidably fitted in a distributing cylinder chamber 11 of a distributing head 15. The head 15 is supported by the pump housing 3.

Rollers 13 roll on a cam surface 12 of the face cam 9. When the face cam 9 is rotated upon rotation of the cam shaft 4, cam surface 12 is put in slidable contact with the rollers 13 by the force of a restoring spring 14, whereby the face cam 9 can reciprocate along the axial direction of the cam shaft 4. In other words, the plunger 10 rotates and reciprocates in the distributing cylinder chamber 11 upon rotation of the cam shaft 4. In particular, the plunger 10 reciprocates a plurality of times corresponding to the number of cylinders of the engine while the plunger 10 is rotated by one revolution.

The interior of the distributing cylinder chamber 11 is defined as a pump chamber 16 by the plunger 10. A plurality of suction grooves 17 are formed at equal intervals along the outer surface of the head of the plunger 10. The suction grooves 17 communicate with the pump chamber 16. The suction grooves 17 can also selectively communicate with an intake channel 18 formed in the head 15 at a predetermined angular position of the plunger 10. The intake channel 18 permanently communicates with the fuel supply chamber 2.

A communicating channel 19 is formed to extend axially along a central portion of the plunger 10. The communicating channel 19 communicates with the pump chamber 16. A distributing groove 20 is formed at a central portion of an outer surface of the plunger 10. The distributing groove 20 communicates with the communicating channel 19. The distributing groove 20 can also communicate with one of discharge channels 21 formed in the head 15 at a predetermined angular position of the plunger 10. The number of discharge channels 21 corresponds to the number of cylinders of the engine. Only one discharge channel 21 is illustrated in FIG. 1. Each of the discharge channels 21 is connected to a fuel injection nozzle (not shown).

The communicating channel 19 can also communicate with the fuel supply chamber 2 through a spill port 24. The spill port 24 can be opened/closed by a spill ring 25 slidably fitted on the outer surface of the plunger 10.

The spill ring 25 is used to control the opening/closing timing of the spill port 24. In particular, the spill ring 25 is coupled to an adjusting lever 28 through a tension lever 26 and a spring 27. Therefore, the spill ring 25 is moved along the axial direction of the plunger 10 through adjusting lever 28, the spring 27 and the tension lever 26.

The tension lever 26 is coupled to a centrifugal governor 30 through a supporting lever 29. The centrifugal governor 30 is rotated by the cam shaft 4 through gears 31 and 32. When the centrifugal governor 30 is rotated upon rotation of the cam shaft 4, the centrifugal governor 30 actuates its governor sleeve 33 in accordance with the engine speed, thereby moving the spill ring 25 along the axial direction of the plunger 10 through the supporting lever 29.

The operation of the fuel injection pump 1 is described below. When the cam shaft 4 is rotated in synchronism with the engine, the plunger 10 reciprocates in the distributing cylinder chamber 11 by the action of the face cam 9 and the rollers 13. When the plunger 10 is moved in a direction so as to increase the volume of the pump chamber 16, one of the suction grooves 17 communicates with the intake channel 18 upon rotation of the plunger 10. Therefore, the fuel is drawn by suction from the fuel supply chamber 2 and is introduced to the pump chamber 16 through the intake channel 18 and the suction groove 17. This operation is the fuel intake process of the pump 1. During the intake process, the spill port 24 is closed by the spill ring 25, and the distributing groove 20 is also held in the closed position. Thereafter, when the plunger 10 is moved in the direction to decrease the volume of the pump chamber 16, upon rotation of the plunger 10, the suction groove 17 which has been communicating with the intake channel 18 no longer communicates therewith. In this condition, the fuel in the pump chamber 16 is pressurized by the plunger 10. The fuel pressurizing process of the pump 1 is thus started.

During this pressurizing process, when the fuel in the pump chamber 16 is pressurized to a predetermined pressure, the distributing groove 20 starts communicating with one discharge channel 21 upon rotation of the plunger 10. Therefore, the pressurized fuel in the distributing pump chamber 16 is delivered to the fuel injection nozzle through the communicating channel 19, the distributing groove 20 and the discharge channel 21. At the end of the fuel pressurizing process, the spill port 24 is opened by the spill ring 25, so that the pressurized fuel in the pump chamber 16 spills into the fuel supply chamber 2 through the communicating channel 19 and the spill port 24. In this condition, the fuel may not be delivered to the discharge channel 21 through the distributing groove 20. As a result, in the pressurizing process, the amount of fuel delivered to the fuel injection nozzle is adjusted by the timing at which the spill port 24 is opened.

Meanwhile, the spill ring 25 is moved along the axial direction of the plunger 10 by the adjusting lever 28 and the centrifugal governor 30, so that the position of the spill ring 25 relative to the spill port 24 changes in accordance with the operating conditions of the engine. That is, a timing at which the spill port 24 is opened/closed changes in accordance with the engine speed (or the degree of depression of an accelerator pedal). As a result, the amount of fuel to be delivered from the pump 1 to the fuel injection nozzle can be adjusted in accordance with the operating conditions of the engine.

The above-described operation indicates the fuel delivery process with respect to a single fuel injection nozzle. However, in practice, the fuel delivery processes are repeated by a number of times corresponding to the number of cylinders of the engine while the plunger 10 is rotated by one revolution. The proper amount of pressurized fuel is delivered to each of the fuel injection nozzles.

FIGS. 2 and 3 show an accumulator 40 for accumulating part of the pressurized fuel delivered from the pump 1. The accumulator 40 includes a cylindrical body 42 having a threaded portion 41 at one end portion thereof. The threaded portion 41 of the cylindrical body 42 is screwed into a screw hole 44 formed in the distributing head 15 through an O-ring 43 so as to provide an oil-tight coupling. The cylindrical body 42 is mounted on the head 15 coaxial with the central axis of the plunger 10.

A seal plate 45 is fitted in one end face of the cylindrical body 42. Since the cylindrical body 42 is mounted in the head 15, the seal plate 45 abuts against the inner end face of the hole 44 in an oil-tight manner. In practice, as may be apparent from FIG. 2, the pump chamber 16 is defined by the plunger 10 and the seal plate 45 in the cylinder chamber 11. An annular groove 46 is defined by the inner surface of the hole 44, one end face of the cylindrical body 42, and the seal plate 45.

The accumulator hole which communicates with the pump chamber 16 is formed in the seal plate 45. A cylinder chamber 47 is formed in the cylindrical body 42 so as to communicate with the accumulator hole. The diameter of the cylinder chamber 47 is larger than that of the accumulator hole. An accumulator piston 48 is fitted in the accumulator hole and the cylinder chamber 47 in an oil-tight manner. The accumulator piston 48 has a pressure-receiving piston 50 defining an accumulator chamber 49 which communicates with the pump chamber 16. Further, the accumulator piston 48 has a control piston 53 which is oil-tightly fitted in the cylinder chamber 47 to be rotatable and slidable therein so as to partition the cylinder chamber 47 into a communication chamber 51 and an oil-tight chamber 52. The pressure-receiving piston 50 and the control piston 53 are respectively aligned on the central axis of the plunger 10. Referring to FIG. 2, a left piston rod 54 of the control piston 53 always abuts against the pressure-receiving piston 50, thereby shifting the pressure-receiving piston 50 and the control piston 53 together along the axial direction.

A supply hole 55 is formed in the cylindrical body 42 to always communicate with the oil-tight chamber 52 independently of the position of the control piston 53. The supply hole 55 communicates with the annular groove 46 through a check valve chamber 56 and a supply chamber 57 which are defined in the cylindrical body 42. Furthermore, the annular groove 46 communicates with the fuel supply chamber 2 through a supply channel 58 defined in the head 15. Therefore, the fuel in the fuel supply chamber 2 is supplied to the oil-tight chamber 52 through the supply channel 58, the annular grove 46, the supply chamber 57, the check valve chamber 56 and the supply hole 55. A check valve 90 is disposed in the check valve chamber 56 and is urged by a spring 59. When the pressure of the fuel in the oil-tight chamber 52 becomes lower than that of the fuel in the fuel supply chamber 2, the check valve 90 allows communication between the check valve chamber 56 and the supply chamber 57. However, when the pressure of the fuel in the oil-tight chamber 52 is higher than that of the fuel in the fuel supply chamber 2, the check valve 90 prevents the check valve chamber 56 from communicating with the supply chamber 57.

A spill port 60 opened to the oil-tight chamber 52 and a communication hole 61 for communicating with the communication chamber 51 are defined in the cylindrical body 42. The spill port 60 and the communication hole 61 communicate with the annular groove 46 through a communication channel 62 defined in the cylindrical body 42. Therefore, the spill port 60 and the communication hole 61 communicate with the fuel supply chamber 2.

An opening 63 of the spill port 60 opened to the oil-tight chamber 52 is opened/closed by the control piston 53. In one end of the control piston 53 which faces the oil-tight chamber 52, an annular surface is formed around a right piston rod 64 axially extending from the control piston 53. This annular surface is formed on a helical control surface 65 as a spill lead surface which is symmetrical about the axial direction. Therefore, when the control piston 53 is moved to the right in FIG. 2 and it closes the spill port 60, the displacing distance of the control piston 53 corresponds to a distance between the control surface 65 and the spill port 60. More particularly, since the axial distance between the control surface 65 and the spill port 60 changes corresponding to the pivotal position of the control piston 53, the displacing distance of the control piston 53 changes in accordance with the pivotal position of the control piston 53.

A bore 66 is defined to the right of the oil-tight chamber 52 in the cylindrical body 42 in FIG. 2. The bore 66 is opened at the other end face of the cylindrical body 42. A pair of partition plates 67 and 68 are disposed in the bore 66 and are spaced apart from each other along the axial direction of the bore 66. A ring 69 is sandwiched between the partition plates 67 and 68. A space defined by the partition plates 67 and 68 and the ring 69 corresponds to a vane chamber 70.

The right piston rod 64 of the control piston 53 slidably extends through a partition wall between the oil-tight chamber 52 and the bore 66 in an oil-tight manner. The right piston rod 64 further extends through the partition plates 67 and 68. Flat surfaces 71 parallal to each other as shown in FIG. 3 are axially formed along an outer surface portion of the right piston rod 64 which extends through the partition plates 67 and 68.

A vane wheel 72 having vanes is housed in the vane chamber 70. The vane wheel 72 is mounted at a portion of the right piston rod 64 which corresponds to the flat surfaces 71. The vane wheel 72 is rotated together with the right piston rod 64. It should be noted that the right piston rod 64 is slidable in the axial direction relative to the vane wheel 72. The vane wheel 72 is coupled to the partition plate 68 by a torsion coil spring 73 as shown in FIGS. 2 and 3. The vane wheel 72 is urged by the torsion coil spring 73 to rotate counterclockwise in FIG. 3.

The vanes of the vane wheel 72 are pivoted to slide along the inner surface of the ring 69, thereby defining two fluid intake chambers 74 and two low-pressure chambers 75 between the ring 69 and the vane wheel 72, as shown in FIG. 3. The fluid intake chambers 74 communicate with the communication channel 62 through the fluid intake ports 76 formed in the partition plate 67 and an annular groove 77 which is formed in the cylindrical body 42 and which is adjacent to the partition plate 67. Therefore, the fuel is supplied from the fuel supply chamber 2 to the fluid intake chambers 74 through the supply channel 58, the annular groove 46, the communication channel 62, the annular groove 77 and the fluid intake ports 76. The diameter of each of the fluid intake ports 76 is very small, thereby, a variation in fuel pressure in the supply channel 58 will not affect the pressure of the fuel in the fluid intake chambers 74. The low-pressure chambers 75 communicate with a space 80 through spill ports 78 formed in the partition plate 68. The space 80 is defined by the partition plate 68 and a cap 79.

The cap 79 is screwed in an opening of the cylindrical body 42 through a threaded portion 81 formed at its one end. The cap 79 serves to urge the partition plates 67 and 68 and the ring 69 to keep them in the bore 66. The space 80 is kept oil-tight by an O-ring 82.

The end portion of the right piston rod 64 extends in the space 80. A spring seat 83 is pivotally mounted at the end of the right piston rod 64. A coil spring 85 is disposed between the spring seat 83 and a spring seat 84 disposed on the inner end face of the cap 79. The right piston rod 64 is urged to the left in FIG. 2 by the biasing force of the spring 85.

A through hole 86 is formed in the cap 79 to communicate with the space 80. The through hole 86 communicates with a fuel tank (not shown) through a hose (not shown). Therefore, the space 80 and the low-pressure chambers 75 are held at substantially atmospheric pressure.

The basic operation of the accumulator 40 will be described hereinafter.

When the fuel in the pump chamber 2 is being pressurized by the fuel injection pump 1, the left end face of the pressure-receiving piston 50 of the accumulator piston 48 (FIG. 2) receives the pressure of the pressurized fuel in the pump chamber 16. The pressure-receiving piston 50 is then moved to the right together with the control piston 53 against the urging force of the spring 85. In this condition, the fuel in the oil-tight chamber 52 is pressurized by the control piston 53. The pressurized fuel which corresponds to a decreased volume following the movement of the control piston 53 is spilled from the oil-tight chamber 52 to the fuel supply chamber 2 through the spill port 60, the communication channel 62, the annular groove 46 and the supply channel 58. At the same time, the fuel which corresponds to an increased volume of the communication chamber 51 upon movement of the control piston 53 is supplied from the communication channel 62 to the communication chamber 51 through the communication hole 61.

When the control piston 53 is further moved to the right and closes the spill port 60, the fuel in the oil-tight chamber 52 cannot be spilled through the spill port 60. Therefore, when the spill port 60 is closed, the control piston 53 and the pressure-receiving piston 50 (i.e., the accumulator piston 48) cannot be moved to the right. As a result, part of the fuel in the pump chamber 16 which corresponds to the displacement of the accumulator piston 48 is accumulated in the accumulator chamber 49. The amount of pressurized fuel supplied from the pump chamber 16 to the fuel injection nozzle is decreased. In other words, the injection rate of the fuel injected to the combustion chamber of the engine is decreased.

Thereafter, the fuel pressurizing process is completed and then the intake process is started. The pressure of the fuel in the pump chamber 16 is decreased. Therefore, the accumulator piston 48 returns to the left due to the urging force of the spring 85. Upon movement of the accumulator piston 48, the volume of the oil-tight chamber 52 is increased, and the pressure of fuel in the oil-tight chamber 52 is decreased. As a result, the check valve 90 is opened, and the fuel is supplied from the fuel supply chamber 2 to the oil-tight chamber 52 through the supply channel 58, the annular groove 46, the supply chamber 57, the check valve chamber 56 and the supply port 55. Furthermore, when the accumulator piston 48 is moved to the left and the spill port 60 is opened by the control piston 53, the fuel is supplied from the fuel supply chamber 2 to the oil-tight chamber 52 through the supply channel 58, the annular groove 46, the communicating channel 62 and the spill port 60. The fuel supply to the oil-tight chamber 52 is stopped when the pressure of the fuel in the oil-tight chamber 52 becomes equal to that in the fuel supply chamber 2.

As may be apparent from the basic operation of the accumulator 40 as described above, the displacement of the accumulator piston 48 to the right determines the fuel injection rate from the fuel injection pump 1.

Figure 4:
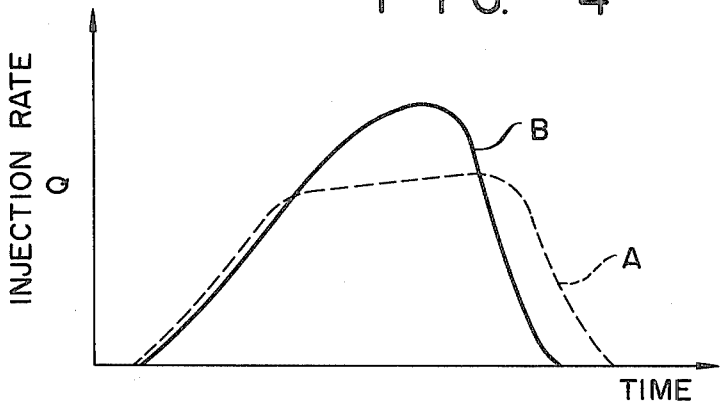
FIG. 4 is a graph for comparing two lines, each indicating the injection rate as a function of time in the delivery process of pressurized fuel.

The function of the accumulator 40 will now be described in a case where the fuel injection rate of the fuel injection pump 1 is adjusted in accordance with the operating state of the engine. For example, when the engine is operated at a low speed (i.e., idling), the fuel pressure in the fuel supply chamber 2 is low, as previously described, so that the pressure of the fuel supplied to the fluid intake chambers 74 through the supply channel 58, the annular groove 46, the communication channel 62 and the fluid intake port 76 is also low. In this condition, the vane wheel 72 is rotated together with the control piston 53 until the fuel pressure in the fluid intake chambers 74 balances with the biasing force of the torsion coil spring 73. If the axial distance of the control piston 53 between the control surface 65 and the spill port 60 is set to be long when the control piston 53 is pivoted at the predetermined position, the displacement distance of the accumulator piston 48 so as to close the spill port 60 is elongated. Therefore, the amount of the pressurized fuel to be accumulated in the accumulator chamber 49 is increased, so that the injection rate of the fuel is greatly decreased. When the adjusting lever 28 is adjusted to set the position of the spill ring 25 so as to extend the injection time at idling, a decrease in the injection amount by a decrease in the injection rate can be compensated, as indicated by the characteristic curve A in FIG. 4. As a result, the injection rate at idling is decreased, thereby decreasing combustion noise during idling.

On the other hand, when the rotational frequency is increased to operate the engine at an intermediate or high speed, the fuel pressure in the fuel supply chamber 2 is increased in accordance with an increase in engine speed. For this reason, the pressure of the fuel supplied to the fluid intake chambers 74 is increased, so that the vane wheel 72 is pivoted together with the control piston 53 clockwise in FIG. 3 against the biasing force of the torsion coil spring 73.

In this condition, since the control surface 65 of the control piston 53 is helically formed, the axial distance between the control surface 65 and the spill port 60 is decreased with respect to the pivotal position of the control piston 53, as compared with the axial distance in idling. Therefore, the displacement of the accumulator piston 48 to close the spill port 60 is decreased. Since the displacement of the accumulator piston 48 is stopped in the fuel injection pump 1 at an early stage of the pressurizing/delivering process, the amount of pressurized fuel accumulated in the accumulator chamber 49 is small. In other words, as indicated by the characteristic curve B in FIG. 4, the injection rate is decreased before the fuel is ignited. The injection rate is abruptly increased when the fuel is ignited. Therefore, effective combustion of the fuel can be performed in the combustion chamber, thereby increasing the output power of the engine.

If the pivotal position of the control piston 53 is set such that the axial distance between the control surface 65 and the spill port 60 is substantially zero, the accumulator piston 48 can not be substantially moved. As a result, the injection rate will not be decreased. In this case, when the adjusting lever 28 is set at the position corresponding to that in idling, the injection amount of the fuel at the start of the engine is increased, thereby starting the engine smoothly.

According to the accumulator 40 constructed as described above, the injection rate of the fuel in the fuel injection pump 1 can be optimally adjusted throughout the various operating states of the engine, thereby improving engine performance. If the biasing force of the spring 85 is applied upon pivotal movement of the accumulator piston 48, smooth movement cannot be performed. However, the accumulator piston 48 is pivoted when it is moved to the left. In this position, since the spring seat 83 abuts against the partition plate 68, the biasing force of the spring 85 can not be applied to the accumulator piston 48.

The present invention is not limited to the particular embodiment described above. The distributor fuel injection pump is exemplified in the above embodiment. However, a tandem fuel injection pump may be used in place of the distributor fuel injection pump. If the fuel pressure in the fuel supply chamber 2 is high enough to eliminate air bubbles formed by cavitation, the check valve 90 may be eliminated.

Furthermore, the fluid for operating the vane wheel 72 is not limited to fuel. Any fluid such as an engine oil may be used if the pressure thereof is controlled in accordance with the operating state of the engine.

Figure 5:
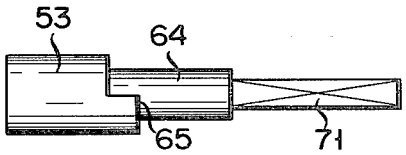
FIG. 5 is a side view of an accumulator piston according to another embodiment of the present invention.

The control surface 65 is also not limited to a helical surface. For example, a stepwise surface may be used in place of the helical surface (FIG. 5).

The control piston 53 and the pressure-receiving piston 50 may be formed integrally, and the accumulator 40 may be coupled midway along the channel which connects the injection nozzle to the pump 1 so as to accumulate the fuel.

According to the present invention, the amount of pressurized fuel accumulated in the pump chamber changes in accordance with a volume corresponding to the displacement of the accumulator piston. Therefore, the injection rate can be controlled in accordance with the given operating state of the engine, thereby obtaining the proper injection rate for the engine.

What is claimed is:

1. A fuel injection device for injecting pressurized fuel into a combustion chamber of an internal combustion engine, comprising:

a pump housing;

a pump cylinder provided in said pump housing;

a pump plunger fitted in said pump cylinder to be reciprocal therein, said pump plunger defining a fuel pressurizing chamber for receiving the fuel in said pump cylinder;

pressurizing means for reciprocating said pump plunger in said pump cylinder in synchronism with operation of the engine, thereby pressurizing the fuel in the fuel pressurizing chamber to supply the pressurized fuel to the combustion chamber; and an accumulator for accumulating part of the pressurized fuel delivered from the fuel pressurizing chamber to the combustion chamber, said accumulator including cylinder means having a first cylinder portion and a second cylinder portion, piston means having an accumulator piston, said accumulator piston having first and second piston portions for reciprocating in said first and second cylinder portions, respectively, said first piston portion defining an accumulation chamber in said first cylinder portion which receives the part of the pressurized fuel pressurized by the fuel pressurizing chamber, said second piston portion being pivotal in said second cylinder portion and defining a fluid-tight chamber filled with a fluid therein, said second cylinder portion having a spill port, the spill port being capable of communicating with the fluid-tight chamber and closed by a predetermined position of said second piston portion upon pivotal movement of said second piston portion, whereby the fluid in the fluid-tight chamber is spilled through the spill port when the spill port is opened, so that said accumulator piston is moved by a pressure of the pressurized fuel in the accumulation chamber so as to increase a volume of the accumulation chamber, and the fluid-tight chamber is closed when the spill port is closed, so that movement of said accumulator piston is interrupted, supplying means for supplying a pressurized fluid whose pressure is adjusted in accordance with a given operating state of the engine, and adjusting means having a fluid pressure chamber which receives the pressurized fluid so as to adjust a pivotal position of said second piston portion in accordance with a variation in pressure of the pressurized fluid in the fluid pressure chamber, thereby adjusting an axial displacing distance of said accumulator piston until said second piston portion closes the spill port.

2. A device according to claim 1, wherein said supplying means has a fuel supply chamber which is defined in said pump housing and which communicates with the fluid pressure chamber, the fuel being supplied to the fuel supply chamber by a feed pump driven in synchronism with the operation of the engine, the pressure of the fuel being variable in accordance with the operation of the engine.

3. A device according to claim 2, wherein the fuel supply chamber communicates with said spill port.

4. A device according to claim 2, wherein the fuel supply chamber communicates with the fluid-tight chamber.

5. A device according to claim 4, wherein the fuel supply chamber communicates with the fluid-tight chamber through a channel, the channel having a check valve for preventing reverse flow of the fuel supplied from said fluid-tight chamber to said fuel supply chamber.

6. A device according to claim 1, wherein said accumulator piston is disposed coaxial to said pump plunger.

7. A device according to claim 6, wherein the accumulator chamber directly communicates with the fuel pressurizing chamber.

8. A device according to claim 6, wherein said accumulator piston has said first and second piston portions which are separated from each other, said first and second piston portions being held to be in contact with each other so as to reciprocate together.

9. A device according to claim 6, wherein said accumulator piston has said first and second piston portions which are formed integrally with each other.

10. A device according to claim 2, wherein said adjusting means includes:

a casing; and a vane wheel disposed in said casing such that vanes thereof are slidably disposed to pivot together with said second piston portion, said vane wheel defining a fluid pressure chamber surrounded by an inner surface of said casing and the vanes in said casing.

11. A device according to claim 10, wherein said vane wheel is axially movable relative to said second piston portion.

12. A device according to claim 10, wherein said adjusting means further has a channel which connects the fluid pressure chamber and the fuel supply chamber, the channel having an aperture having a small sectional area.

13. A device according to claim 1, wherein said pump plunger is a distributor plunger of a distributor fuel injection pump.

* * * * *